United States Patent [19]

Healy

[11] 4,062,494

[45] Dec. 13, 1977

[54] SPRINKLER HEAD SEALING APPARATUS

[75] Inventor: Mark Healy, Orlando, Fla.

[73] Assignee: Senninger Irrigation, Inc., Orlando, Fla.

[21] Appl. No.: 697,319

[22] Filed: June 18, 1976

[51] Int. Cl.[2] ..... B05B 3/02

[52] U.S. Cl. ..... 239/230; 239/264

[58] Field of Search ..... 308/187.1, 238, 36.1; 239/230–233, 261, 264

[56] References Cited

U.S. PATENT DOCUMENTS

| | | | |
|---|---|---|---|
| 2,592,645 | 4/1952 | Kayser | 308/187.1 X |
| 3,331,642 | 7/1967 | Krauss | 308/36.1 |
| 3,764,073 | 10/1973 | Costa et al. | 239/230 |
| 3,799,631 | 3/1974 | Martina | 239/230 X |
| 3,957,205 | 5/1976 | Costa | 239/230 |

*Primary Examiner*—John J. Love

*Attorney, Agent, or Firm*—Duckworth, Hobby, Orman, Allen & Pettis

[57] ABSTRACT

A rotatable head sprinkler apparatus incorporates a lower bearing seal between a swivel device for connection to a source of water under pressure, and a spindle connected through said swivel device to a self-powered rotary sprinkler head of the type used for irrigation. A bearing washer is formed into the swivel device and forms a coupling for a protective seal which prevents the entry of trash, or the like, into the area between the seal and the wear washer.

9 Claims, 3 Drawing Figures

SPRINKLER HEAD SEALING APPARATUS

BACKGROUND OF THE INVENTION

1. Field of the Invention

This invention relates to sprinkler seals and wear washers and more particularly to sprinkler seals and wear washers in sprinklers having rotary heads which are powered by the pressure of the water being used for irrigation. This invention is an improvement over my prior invention for Sprinkler Head Searing Means, Ser. No. 593,373, now U.S. Pat. No. 3,968,934.

2. Description of the Prior Art

Rotary head sprinklers, especially the impulse type step-by-step rotary sprinklers, have been used extensively in irrigation of agricultural fields such as orange groves, corn fields, and the like. In dry seasons these sprinklers may be used almost continuously to supply the moisture required for proper plant growth. Multiple sprinkler heads are frequently combined into large irrigation systems which are usually elevated above the crops to be irrigated. These irrigation systems are usually fed with river, lake, or well water which has been only coursely filtered to remove large objects. Quite often sand and other small particulate matter is suspended in the irrigation water and transferred through the pipes to the sprinkler heads. The high pressure used in the sprinkler systems can easily force such particulate matter between the lower seal bearing surfaces of the rotating head sprinkler devices, thereby causing rapidly accelerated wearing characteristics of the bearing surfaces. This wear becomes even more untenable when the sprinkler heads cannot be replaced easily from their inaccessibly high mounting positions.

Previous inventors have attempted to shield the lower bearing seal which separates the spindle and swivel mechanisms, thereby permitting the use of ordinary flat washers. In U.S. Pat. No. 3,080,123, Erns uses a single washer which acts as a combined wear washer and seal. In U.S. Pat. Nos. 3,204,873 and 3,204,874, Senninger uses a single wear washer and a single seal which are both semi-shielded from the water flow. In U.S. Pat. No. 2,904,261, Johnson uses a single wear washer with two seals which are both semi-shielded from the water pressure. Other references include U.S. Pat. No. 3,869,925, Crow; U.S. Pat. No. 3,669,356, Senninger; U.S. Pat. No. 3,310,796, Lappin; U.S. Pat. No. 3,086,515, Evans; U.S. Pat. No. 1,501,718, Olschewski; U.S. Pat. No. 1,710,107, Orr; U.S. Pat. No. 3,356,737, Englehart; U.S. Pat. No. 3,110,112, Rippey; U.S. Pat. No. 3,792,256, Sinex; U.S. Pat. No. 3,033,469, Green; U.S. Pat. No. 3,043,552, Ryerson; U.S. Pat. No. 3,193,203, Crow; U.S. Pat. No. 3,993,649, Holz; U.S. Pat. No. 3,017,123, Rinkewich; and U.S. Pat. No. 2,878,062, Crow. One recent U.S. Pat. No. 3,764,073, for a sprinkler head mounting means to Costa, et al, teaches a sprinkler head having sacrificial wear washers and special seals.

SUMMARY OF THE INVENTION

The present invention relates to a lower bearing seal for a rotatable sprinkler head having a swivel for connection to a source of water under pressure. The swivel has a bore passing through it and a spindle is movably mounted through the bore of the swivel and connected to the sprinkler head for rotation therewith. The spindle has a flange at the opposite end from its connection to the remainder of the sprinkler head and has a bore passing between its ends. A wear washer is made of a material different from the swivel and is formed into one end portion of the swivel to act as both the wear washer and to form a coupling ridge on the swivel for coupling to a sealing washer located on the spindle between the wear washer and the flanged portion on the spindle. The seal has a lip along its periphery which overlaps the outer periphery of the wear washer to prevent the entry of sand or other contaminates. The wear washer is formed with an annular periphery groove to prevent its loosening from the swivel. The seal is provided with external and internal tapered surfaces to prevent the external surface from binding during rotation and to improve the sealing characteristics with the internal taper of the seal lip.

BRIEF DESCRIPTION OF THE DRAWINGS

Other objects, features, and advantages of this invention will be apparent from a study of the written description of the drawings in which.

DESCRIPTION OF THE PREFERRED EMBODIMENT

Figure 1:
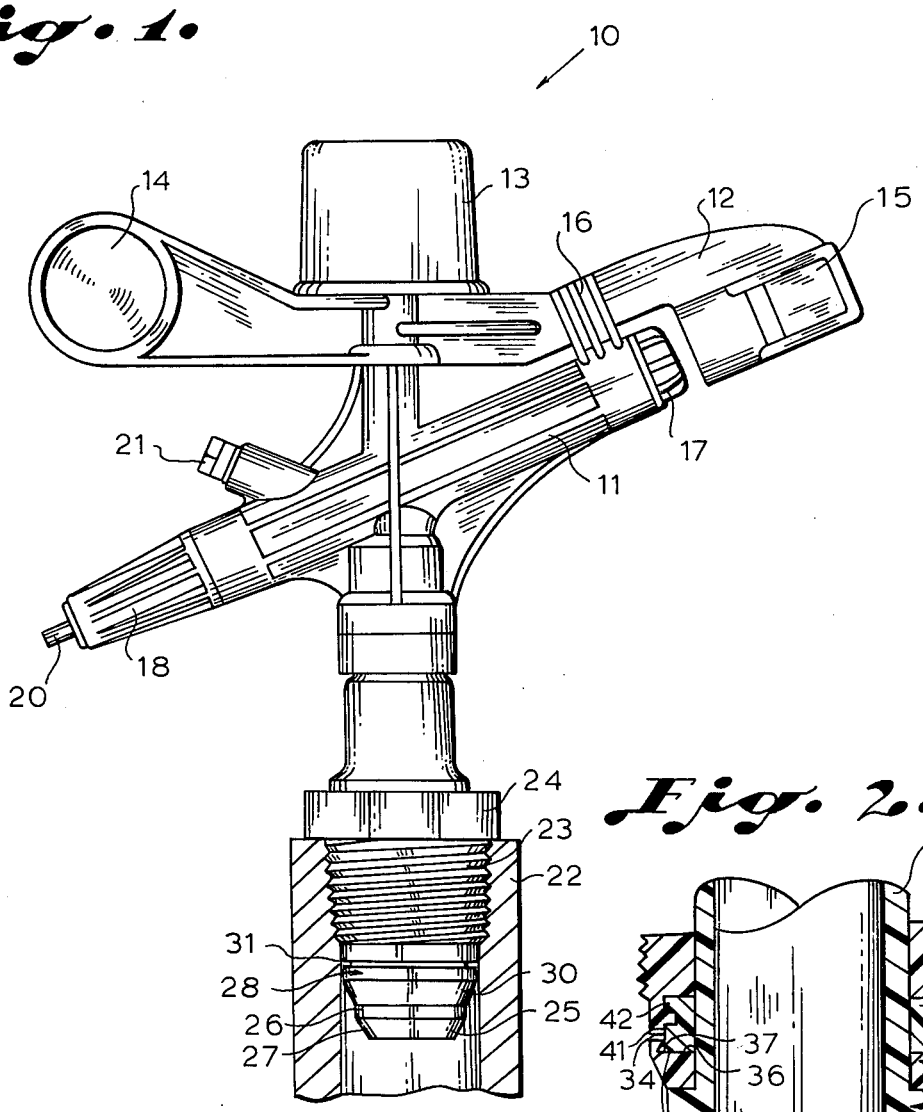
FIG. 1 is a front elevation of a sprinkler in accordance with a preferred embodiment of the present invention connected to an irrigation water riser pipe.

A rotary irrigation sprinkler 10 of the impulse arm step-by-step type is illustrated in FIG. 1 having a sprinkler head body 11 with an impulse arm 12 which is operated by a spring located under the spring cover 13. Impulse arm 12 has a water engaging spoon 15 and an impulse arm counter weight 14 on the other end thereof. A protruding member 16 is attached to the sprinkler body 11 for stopping the impulse arm 12 from proceeding past a certain point when the sprinkler is not in operation. The sprinkler head body 11 has a removable nozzle 17 mounted on one end and a rear removable cap 18 on the other end which encloses a mechanism of which the tailend 20 is illustrated for preventing dirt daubers, or other insects, from building nests in the sprinkler system during the off season and thereby preventing costly maintenance of the sprinklers. A rear protruding nozzle 21 may be used to sprinkle in a smaller radius from the rear of the sprinkler to provide a more even distribution to the sprinkled area if desired.

The irrigation sprinkler assembly 10 is mounted to a riser pipe 22 by threaded section 23 of a swivel 24. The swivel 24 has a spindle 25 (FIG. 3) having an end flanged portion 26 visible in this view which flanged portion has a tappered portion 27 to prevent the binding of the spindle with connecting pipes in riser pipe 22. A lower bearing assembly sealing washer 28 also has a tapered surface 30 to prevent binding of the bearing against any protruding connections in the riser pipe 22. The lower bearing seal has an annular sealing lip 31 around its periphery which extends over a bearing washer 32 as seen in FIGS. 2 and 3.

Figure 2:
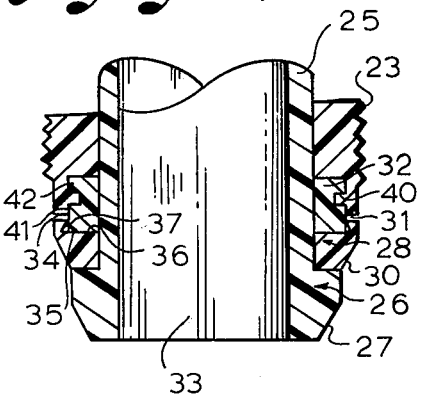
FIG. 2 illustrates a sectional view of the lower bearing seal.
Figure 3:
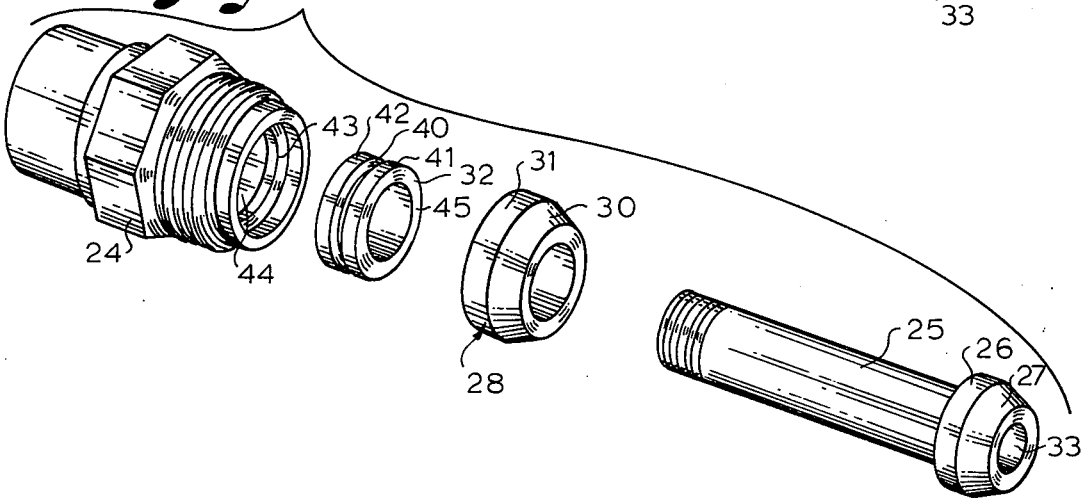
FIG. 3 shows an exploded perspective view of the lower bearing seal, the spindle, and the swivel.

Referring more particularly to FIGS. 2 and 3, the swivel 24 having the spindle 25 passing therethrough and having a bore 33 passing therethrough is illustrated having its flanged portion 26 having an end tapered portion 27. The lower bearing washer 32 has been formed during the molding operation directly into the swivel 24 as illustrated in FIG. 2 and is rigidly attached therto which prevents its rotation but allows it to protrude from the end 34 of the swivel 24 forming a coupling ridge 35 protruding from the end 34. The lower bearing seal 28 has a tapered portion 30, along with a nnular lip 31, protruding from its periphery. The seal thus forms a bearing surface 36 with a protective lip 34 to prevent the entry of trash into the space between the bearing surface 36 and the protruding portion 35 of the wear washer. An angled surface 37 formed into the lip 34 of the seal 28 is angled from the top edge of the lip 31 towards the outer periphery of the seal to form a generally triangular shaped cross-section between the lip 31 and the other edge of the protruding portion 35 of the wear washer 32. This provides a secure seal between the sealing washer 28 and the wear washer 23 and prevents the wear washer 28 lip 31 from a tendency to flare out and to allow sand or other contaminates between the seal 28 and the wear washer 32 which would rapidly wear out the wear washer and seal and require replacement. The wear washer 32, which is formed into the swivel 24, has an annular groove 40 formed in its outer periphery thereby forming a pair of annular ridges 41 and 42. When molded into the swivel 24 an annular internal ridge 43 is formed in the bore 44 of the swivel 24 when formed to the shape of the groove 40. This prevents the wear washer 32 from coming loose from the swivel 24 and makes it an itegral part of the swivel 24. Swivel 24, along with most of the remainder of the sprinkler, can be made of conventional polymers while the wear washer 32 might be made of an ultra-high molecular weight polyethylene or teflon providing a solid lubricant surface which wears over a long period of time. Advantageously, the wear washer 32, not only forms a part of the spindle 24, but forms a coupling ridge for coupling with the special seal 28 for preventing the entry of sand, or the like, against the wearing surface 45 of the wear washer 32.

It can thus be seen that by utilizing a specially designed wear washer molded into the swivel and by the use of a special sealing washer, a lower bearing seal is provided which is long lasting and prevents the entry of contaminates which would rapidly disintegrate the bearing surface. The present invention, however, is not to be construed as limited to the particular forms shown which are to be considered illustrative rather than restrictive.

I claim:

1. A rotatable sprinkler head apparatus comprising in combination:

a swivel made of one material and having attaching means for connection to a source of water under pressure, said swivel having a bore therethrough;

spindle means movably mounted through said bore of said swivel and connected at one end to said sprinkler head apparatus, said spindle means having a flange at the opposite end thereof and further having a bore between its ends;

wear washer means made of a second material and formed into one end portion of said swivel and forming a coupling ridge formed on said swivel; and seal means located on said spindle means between said wear washer means and said flange on said spindle means, said seal means having a lip extending about the edge portion thereof with an interior annular tapered surface overlapping said wear washer coupling ridge formed by said wear washer in said swivel, and said seal means having an external tapered surface, whereby said wear washer means and overlapping seal means prevent the entry of sand or other contaminates.

2. The apparatus in accordance with claim 1 in which said wear washer means has a wear washer having an annular groove in its periphery for holding said wear washer means on said swivel.

3. The apparatus in accordance with claim 2 in which said wear washer means is formed of an ultra-high molecular weight polyethylene.

4. The apparatus in accordance with claim 1 in which said seal means lip tapered surface tapers from the top portion of said lip towards the periphery of said seal means.

5. A rotary sprinkler head apparatus comprising in combination:

a swivel having a bore therethrough and having attaching means for connection to a source of water under pressure;

a spindle means movably mounted through said bore of said swivel, said swivel means having a flange at one end thereof and further having a bore between its ends; and seal means located on said spindle means between said swivel and said flange of said spindle means, said seal means having an annular lip formed on the outer edge thereof for coupling with a coupling ridge formed on one end of said swivel, said seal means lip having an internal wall forming a tapered surface tapering from the edge of said lip towards the periphery of said seal means thereby forming a generally triangular spacing between said seal means lip and said swivel coupling ridge whereby sand or other contaminates are prevented from entering between said seal means and said swivel coupling ridge.

6. The apparatus in accordance with claim 5 in which said swivel coupling ridge is formed from a wear washer formed into one end of said swivel.

7. The apparatus in accordance with claim 6 in which said wear washer is made of one material and said swivel is made of a second material and said wear washer is rigidly mounted into the end of said swivel.

8. The apparatus in accordance with claim 7 in which said wear washer has an annular groove formed in its periphery for rigidly securing said wear washer to said swivel when formed in said swivel end.

9. The apparatus in accordance with claim 8 in which said seal means has an exterior tapered portion.

* * * * *